US006071322A

United States Patent [19]

Hulthén

[11] Patent Number: 6,071,322

[45] Date of Patent: Jun. 6, 2000

[54] DUST CONTAINER FOR VACUUM CLEANERS

[76] Inventor: Maj-Britt Hulthén, Box 1094, Z51 10 Helsingborg, Sweden

[21] Appl. No.: 08/932,499

[22] Filed: Sep. 18, 1997

Related U.S. Application Data

[63] Continuation of application No. 08/571,870, filed as application No. PCT/SE94/00631, Jun. 23, 1994, abandoned.

[30] Foreign Application Priority Data

Jul. 7, 1993 [SE] Sweden ..... 9302348

[51] Int. Cl.[7] ..... B01D 46/02

[52] U.S. Cl. ..... 55/367; 15/347; 55/369; 55/374; 55/381; 55/DIG. 2

[58] Field of Search ..... 95/273; 59/361, 59/367, 369, 373, 374, 376, 377, 378, 381, DIG. 2, DIG. 3; 15/347, DIG. 8

[56] References Cited

U.S. PATENT DOCUMENTS

| | | | |
|---|---|---|---|
| 1,513,395 | 10/1924 | Holmes | 55/370 |
| 1,953,189 | 4/1934 | Orr | 55/370 |
| 3,107,989 | 10/1963 | Fesco | 55/381 |
| 3,191,365 | 6/1965 | Feeley | 55/369 |
| 3,370,406 | 2/1968 | Fesco | 55/371 |
| 3,392,906 | 7/1968 | Fesco | 55/361 |
| 3,401,867 | 9/1968 | Long et al. | 55/361 |
| 3,432,998 | 3/1969 | Downey et al. | 55/DIG. 2 |
| 3,479,802 | 11/1969 | Fesco | 55/367 |
| 3,596,443 | 8/1971 | Goldberg | 55/DIG. 2 |
| 3,616,622 | 11/1971 | Friedman | 55/378 |
| 3,755,993 | 9/1973 | Cote | 55/370 |
| 4,299,605 | 11/1981 | Aiyama et al. | 55/370 |

FOREIGN PATENT DOCUMENTS

| | | | |
|---|---|---|---|
| 2407478 | 8/1974 | Germany | 55/DIG. 2 |

*Primary Examiner*—Duane S. Smith
*Attorney, Agent, or Firm*—James Ray & Associates

[57] ABSTRACT

A dust container for vacuum cleaners includes a bag and a front plate. The bag is made of a material that, essentially, is permeable only to air. The front plate encloses a suction opening in the bag. The front plate is of a shape that is independent of the vacuum cleaner model in which the dust container is to be used. A mechanism for attaching a mounting plate to the front plate is also provided for the purpose of fitting the dust container in the vacuum cleaner. The mechanism for attaching the mounting plate to the front plate is designed specifically for the vacuum cleaner in which the dust container is to be used.

7 Claims, 1 Drawing Sheet

DUST CONTAINER FOR VACUUM CLEANERS

This application is a continuation of application Ser. No. 08/571,870, filed Jan. 4, 1996, now abandoned, which is a PCT of PCT/SE94/00631 filed Jun. 23, 1994.

FIELD OF THE INVENTION

The present invention relates generally to a dust container for a vacuum cleaner, more specifically for the type of vacuum cleaner which employs a bag with a suction opening, the bag being made of a material which, essentially, is permeable only to air, and a mounting plate, which can be attached to the bag, provided with a suction opening aligned with the suction opening of the bag, and which mounting plate is designed specifically for the model of vacuum cleaner in which the dust container is to be used, for the purpose of fitting the dust container in that model.

BACKGROUND OF THE INVENTION

At present, dust containers for vacuum cleaners are usually of the disposable type, in addition to which each model of vacuum cleaner normally requires a specially designed dust container.

This obviously means that a range of dust containers must be available, making the cost of each individual container high. The higher cost of commercial handling and storage is obviously an additional contributory factor to this.

Standardization of the method of fitting dust containers in vacuum cleaners would naturally eliminate the need for a large number of different, individually designed dust containers.

OBJECTIVES OF THE INVENTION

A first purpose of the invention is, in the absence of such standardization, to provide a dust container which is essentially suitable for use in practically all current vacuum cleaner models.

A second purpose of the invention is to provide a dust container which is also reusable, that is to say, which is not of the disposable type.

The aforementioned purposes of the invention are achieved by means of a vacuum cleaner dust container of the type described initially, which dust container is characterized in that a front plate enclosing the suction opening of the bag, and being of a shape independent of the model of vacuum cleaner in which the container is to be used, is provided as reinforcement around the suction opening; that the bag material around its (the bag's) suction opening is fixed to the front plate; that means are provided of attaching the mounting plate to the front plate; and that the bag is made of a synthetic material and can be sealed at an end separate from the front plate by folding an open end section adjacent to the said end, and by securing the said end section in the folded position by openable fastening of the opposed, folded surfaces.

A specifically designed front plate from a commercially available dust container of the disposable type may be used as a purpose-made mounting plate.

The front plate may suitably be made in two sections, between which the bag material around the suction opening is fixed, for example, by means of a snap-in arrangement.

The opposed surfaces of the bag created by double folding of the end section may be provided with fastening strips, which may suitably be fastenable to each other and may preferably consist of tape such as the VELCRO brand variety.

The means of attaching the mounting plate to the front plate may be of a permanent nature. A proposed embodiment of such permanent means of attachment may take the form of double-sided adhesive tape attached to the outer side of the front plate.

The bag may preferably be made of some type of synthetic material capable of withstanding repeated use.

The bag may be provided with two oppositely located gripping tabs, between which the front plate is located, to facilitate removal of a dust container from a vacuum cleaner and its fitting in a vacuum cleaner.

The invention will be described in greater detail below, with reference to the accompanying drawings.

DESCRIPTION OF THE PREFERRED EMBODIMENTS

Figure 1:
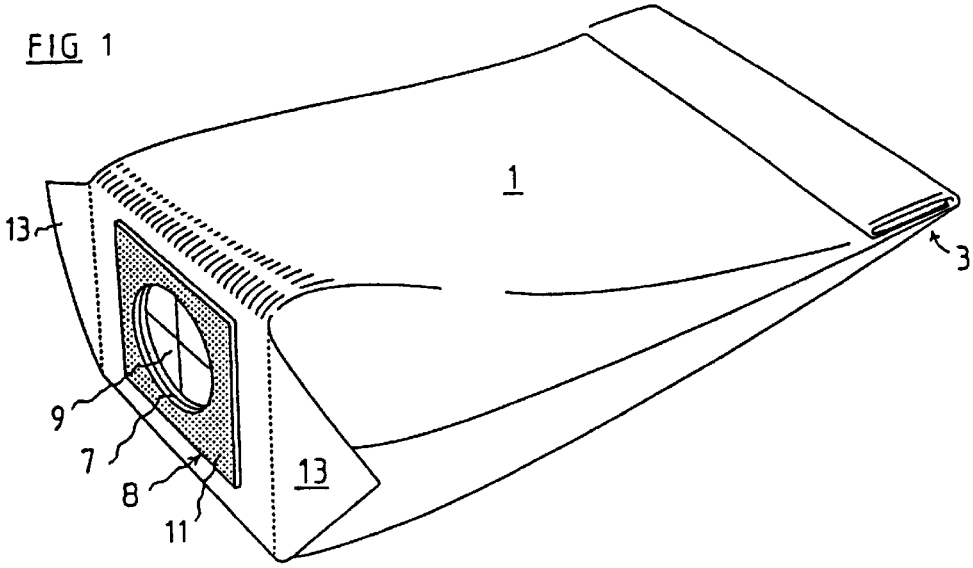
FIG. 1 is a perspective view of an embodiment of a dust container in accordance with the invention.

The embodiment shown in FIG. 1 of a dust container for a vacuum cleaner in accordance with the invention consists of a bag 1 of a material which, essentially, is permeable only to air. In the dust container shown in FIG. 1, which dust container is intended for repeated use, the bag may be made of a fabric which, firstly, complies with the requirement of air permeability and, secondly, is sufficiently durable to permit repeated use.

Figure 3:
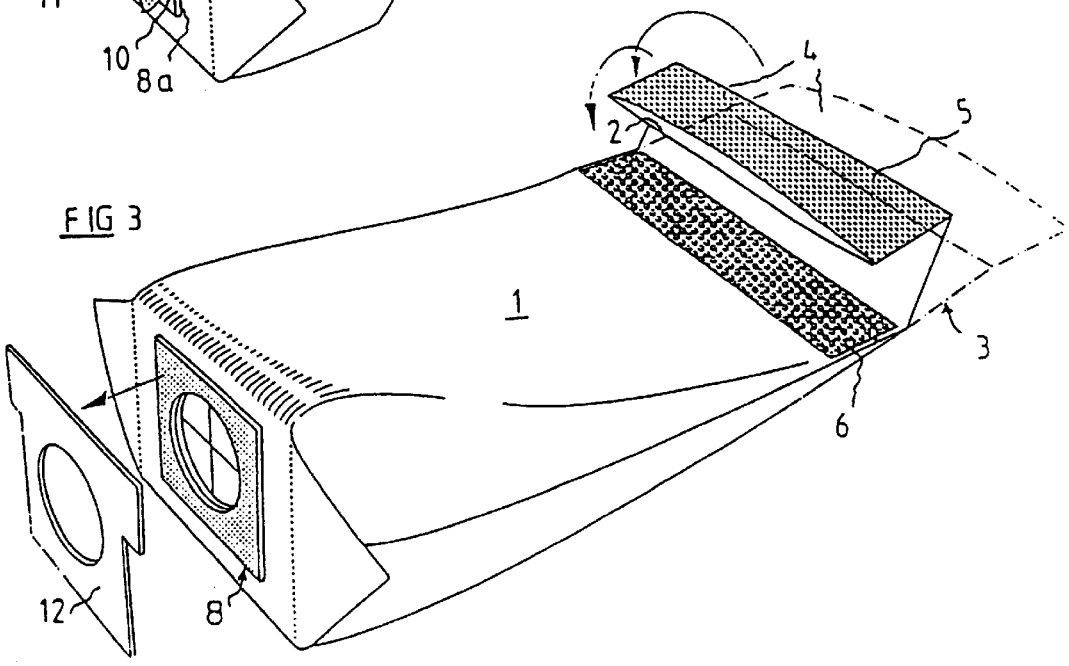
FIG. 3 illustrates the use of a dust container as illustrated in FIG. 1.

As shown in FIG. 3, the bag 1 is provided with an opening 2 at an end 3. Double folding of an end section 4, as illustrated in FIG. 3, and securing of the said end section in the folded position, for example, by means of fastening strips 5, 6, enables the bag to be sealed in a secure manner, while also enabling it to be opened by releasing and unfolding the end section 4 into the position indicated by the broken lines in FIG. 3.

When the dust container in accordance with the invention is fitted in a vacuum cleaner, the end 3 is securely sealed and appears as illustrated in FIG. 1

The bag 1 has a suction opening 7, which is enclosed by a front plate 8. The suction opening 7 may, further, be provided with openable sealing flaps 9, which may either be separate or may form part of the material of the bag 1 or the material of the front plate 8. The sealing flaps 9 are openable when the dust container is fitted in a vacuum cleaner, to permit the dust to pass through the opening 7. The flaps may, furthermore, preferably be spring-loaded to prevent the escape of dust from the opening 7 when removing and emptying the dust container.

Figure 2:
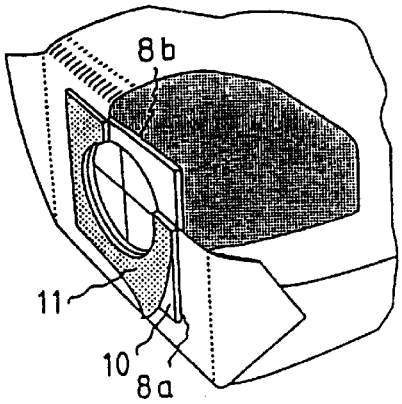
FIG. 2 is a partial cutaway view of part of the dust container illustrated in FIG. 1.

The front plate 8 provides reinforcement around the suction opening 7 and may, as illustrated in FIG. 2, consist essentially of two identical sections, 8*a*, 8*b*, between which the material of the bag 1 around the suction opening is fixed, for example, by gluing, welding or a snap-in arrangement.

To permit the use of the dust container in accordance with the invention in any model of vacuum cleaner, the front plate 8 is of a shape which is independent of the vacuum cleaner in which the dust container is to be used. The plate may suitably be of smaller dimensions than the front plates in most vacuum cleaner models. At the same time, the suction opening 7 is sufficiently large to suit the suction opening of the front plates in most vacuum cleaner models. Furthermore, a double-sided adhesive tape 10, with a protective covering 11, is provided on the outer side of the front plate 8. The double-sided adhesive tape 10 comprises the means used to attach a mounting plate 12, shown in FIG. 3, designed specifically for the vacuum cleaner in which the dust container is to be used, to the front plate 8. The mounting plate 12 is usually of a special shape for each vacuum cleaner model.

Thus, the dust container in accordance with the invention is generally usable and can be adapted simply for each individual model of vacuum cleaner by attachment of a mounting plate 12, designed specifically for the vacuum cleaner in question, to the front plate 8 of the dust container. In this connection, the mounting plate 12 may conveniently be obtained from the specifically designed disposable-type dust container normally used in the vacuum cleaner in question.

The bag 1 is provided with two oppositely located gripping tabs 13, between which the front plate 8 is located, to facilitate fitting of the dust container in accordance with the invention in a vacuum cleaner and its removal from the cleaner.

It is obvious that the embodiment of a dust container in accordance with the invention as described above is advantageous, firstly, in that it can be used with any vacuum cleaner model whatever and, secondly, that it can be used repeatedly. This obviously means that the cost to the consumer is greatly reduced, in addition to which the number of variants which must be stocked by dealers can also be reduced substantially.

I claim:

1. A reusable dust container specifically designed for use in a plurality of vacuum cleaners which are presently equipped with different diameter discharge tubes, said reusable dust container comprising:

(a) a reusable bag member, permeable only to air, for retaining dust particles and other debris therein;

(b) a first generally round opening, having a first predetermined diameter, formed through a substantially flat portion of said reusable bag member located at a first end thereof, said first predetermined diameter being at least sufficient to receive a largest discharge tube utilized in any one of such plurality of different vacuum cleaners;

(c) an openable and reclosable elongated opening formed adjacent a second end of said reusable bag member, said openable and reclosable elongated opening enabling such dust particles and such other debris collected in said reusable bag member to be emptied therefrom and then reclosed for reuse in such vacuum cleaners;

(d) a first securing means secured to said reusable bag member adjacent said second end for securing and maintaining said reusable bag member in a closed position during use in such vacuum cleaner;

(e) at least one plate reinforcing member secured at an inner surface thereof to an outer surface of said substantially flat portion of said reusable bag member located at said first end thereof;

(f) a second generally round opening, having a second predetermined diameter substantially identical to said first predetermined diameter of said first generally round opening, formed through said plate reinforcing member, said second generally round opening being in axial alignment with said first generally round opening; and (g) a second securing means secured at an inner surface thereof to an outer surface of said at least one plate reinforcing member for securing said reusable dust container, at an outer surface of said second securing means, to a particular mounting plate provided with such any one of such plurality of different vacuum cleaners.

2. The reusable dust container, according to claim 1, in which said second securing means comprises a dual-sided adhesive tape bonded via said inner surface thereof to said outer surface of said at least one plate reinforcing member and via said outer surface thereof to such particular mounting plate and generally encircling said second generally round opening.

3. The reusable dust container, according to claim 1, in which said reusable bag member at said first generally round opening is provided with at least one sealing flap adapted to close said first generally round opening when said reusable bag member via said first generally round opening is not mounted onto such discharge tube.

4. The reusable dust container, according to claim 3, in which said sealing flap comprises at least one partially cut portion of said reusable bag member adapted to extend at least partially across said first generally round opening when said reusable bag member via said first generally round opening is not mounted onto such discharge tube.

5. The reusable dust container, according to claim 1, in which said at least one plate reinforcing member comprises two plate reinforcing members a first of which being secured at said inner surface thereof to said outer surface of said substantially flat portion of said reusable bag member and a second of which being secured at an outer surface thereof to an inner surface of said substantially flat portion of said reusable bag member.

6. The reusable dust container, according to claim 1, in which said reusable bag member is provided with a pair of diametrically opposed gripping tabs extending from either side of said substantially flat portion of said reusable bag member.

7. The reusable dust container, according to claim 1, in which said first securing means comprises a pair of strips each of which attached to said reusable bag member and connectable to each other so as to hold said reusable bag member in said closed position during use in such vacuum cleaner.

* * * * *